US005194026A

United States Patent [19]

Corwin et al.

[11] Patent Number: 5,194,026

[45] Date of Patent: Mar. 16, 1993

[54] SURF BOARD LEASH DEVICE AND METHOD THEREFOR

[76] Inventors: Karl B. Corwin, 61-147 Ikuwai Pl., Haleiwa, Hi. 96712; Douglas B. Ekdahl, 1815 S. Parkside Dr., Tempe, Ariz. 85281

[21] Appl. No.: 894,467

[22] Filed: Jun. 5, 1992

[51] Int. Cl.[5] ..... B63B 35/79

[52] U.S. Cl. ..... 441/75; 280/637; 280/816

[58] Field of Search ..... 441/75, 84, 85; 280/637, 816, 809, 87.04

[56] References Cited

U.S. PATENT DOCUMENTS 4,234,990 11/1980 Colburn ..... 441/75
5,058,524 10/1991 Guthrie ..... 280/637

FOREIGN PATENT DOCUMENTS 2383682 11/1978 France ..... 280/637
13160 5/1910 United Kingdom ..... 441/84

*Primary Examiner*—Sherman Basinger
*Assistant Examiner*—Thomas J. Brahan
*Attorney, Agent, or Firm*—Harry M. Weiss

[57] ABSTRACT

This disclosure is directed to a surf board leash device and method that prevents the leash (line) between the surfer's ankle to the surf board from getting tangled up with the surfer's feet. This surf board leash device and method uses a clip on device containing "VELCRO" members as part of a belt clip to allow the leash line to break away from the surfer's waist during a fall or "wipe out" from the surfer's ankle, when the surfer starts to fall off the surf board. In addition, the surfer will be able to surf longer with a higher degree of safety because of not worrying about the surf board leash getting caught between their feet. Thus, the surfer's attention and concentration will be directed at making the ride on the surf board last as long as possible. Furthermore, this new surf board leash device will not cause any damage to the surfer's swimsuit as the leash will breakaway from the swimsuit belt clip when the surfer falls.

14 Claims, 1 Drawing Sheet

SURF BOARD LEASH DEVICE AND METHOD THEREFOR

BACKGROUND OF INVENTION

1. Field of the Invention

The present invention generally relates to leashes and methods therefor for a person to hold onto an object and, more specifically, to an improved surf board leash device and method therefor that permits a person to better use a surf board leash device to hold onto a surf board thereby preventing loss of the surf board during surfing when the person "wipes out" or falls off the surf board.

2. Description of the Prior Art

In the past, surf board leashes were attached to a person's ankle from a ring or connection device attached to the surf board by the use of a line of plastic tubing or rope. The purpose of the surf board leash is to prevent the surf board from being separated or lost from the surfer when the surfer falls off the surf board. Due to the tide of the ocean, a surfer would be sometimes unable to find or stop the surf board from floating out to sea, if the surfer did not use a surf board leash device to attach the surfer to the surf board. However, this prior art surf board leash device and method has proven to be unsatisfactory. For example, the use of such a surf board leash device and method that connected to only a surfer's ankle would usually get caught or tangled between the surfer's feet while the surfer was surfing.

As a result, when the surfer inevitably fell off or "wiped out", the surfer would more likely fall or even suffer an injury due to the fact that the leash was interfering with the surfers legs thereby also causing the fall. Unfortunately, the prior art surf board leash device and method, which prevented the surf board separation problem caused an additional unforeseen problem of either causing the surfer to fall because of entanglement with the surfer's feet or making the fall much more dangerous. If a surfer's feet get caught in the surf board leash, then the surfer is more prone to fall and can also be at the mercy of the surf board connected to the surfer which may cause the surfer to suffer severe injuries due to this predicament. Sometimes a surfer will want to intentionally fall off the surf board if the surfer knows that they are about to get "wiped out" by a particular wave. However, if the surf board leash is tangled up around and between the surfer's feet, the surfer can no longer control their fall and can suffer injuries during the fall.

SUMMARY OF THE INVENTION

It is an object of this invention to provide a new and improved surf board leash device and method that provides a softer attachment to the surf board.

It is a further object of this invention to provide a new and improved surf board leash device and method that can be used to connect the surfer to the surf board without the leash line getting tangled up or caught between the legs of a surfer while the surfer is standing on and using the surf board.

It is a still further object of this invention to provide a new and improved surf board leash device and method which attaches a surf board leash line to the waist of the surfer in such a manner that, if the surfer starts to fall off the surf board, the surf board leash line will easily, through the use of a VELCRO member located at the waist of the surfer, detach or breakaway from the surfer's waist without injuring the surfer or becoming entangled in the legs of the surfer, but still remain attached to the surf board from the surfer's ankle.

The aforementioned and other objects are accomplished, according to the present invention, by attaching a leash line to the surf board which leash line is attached to the surfer's ankle and the leash line also goes up and attaches to the surfer's waist (by a clip attachment to the surfer's bathing or surfing suit) using a break away material like "VELCRO" that is part of the clip attachment. The waist clip attachment stays attached to the surfer's bathing or surfing suit and the leash (which is gripped by the VELCRO break away material) breaks away from attachment to the surfer's waist when the surfer falls off the surf board thereby providing greater control of the location and portion of the leash (which is attached to the surfer's waist and, therefore, can not become entangled between the surfer's feet) until the force of the surfer's fall off the surf board that causes break away of the leash from the control position at the surfer's waist. At this point, the attachment of the leash to the surfer's ankle provides the surfer with a leash connection to the surf board.

The foregoing and other objects, features and advantages of this invention will be apparent from the following, more particular, description of the preferred embodiments of this invention, as illustrated in the accompanying drawings.

DESCRIPTION OF THE PREFERRED EMBODIMENT

Figure 1:
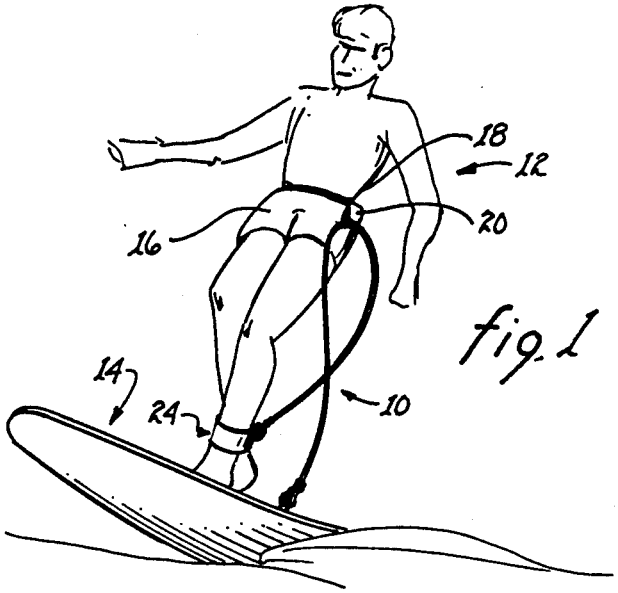
FIG. 1 is a perspective view of a person using a surf board and the surf board leash device and method of this invention.

Referring now to FIG. 1 of the accompanying drawings which set forth the present invention in greater detail and in which like numerals designate like features, a surf board leash device and method is generally designated by reference number 10. The surf board leash device 10, in this embodiment, is shown attached to both the waist and ankle of a surfer 12. The leash device 10 can be made of plastic, rope, tubing or any like material. The leash device 10 is tied to a surf board 14 through attachment to a ring type member (see the upper portion of FIG. 2) that is connected to the surf board 14. After an end portion of the leash device 10 is attached to the surf board 14, the leash device 10 is then attached to the surfer's swimsuit or surfing suit 16 at a portion of waist band 18. The leash device 10 is attached or clipped onto the waist band 18 of the surfer's swimsuit 16 through the use of a clip 20 containing VELCRO portions 22 (see FIGS. 2, 3, and 5) that are used to hold a portion of the leash device 10 in a break away manner due to the use of the VELCRO portions 22. The leash device 10 is also attached to one of the surfer's ankles through the use of a "VELCRO" ankle wrap 24 (see FIGS. 1 and 2). As shown in FIG. 1, the surfer 12 can surf without worrying about or having the leash device 10 becoming caught between the surfer's feet. The leash device 10 must be and is long enough to extend from its connection at one end to the surf board 14, to the surfer's waist band 18 and back down to the surfer's ankle. Thus, the leash type device 10 of this invention permits the surfer to have greater control of the leash thereby preventing injuries to the surfer. As disclosed, this is accomplished by providing a break away connection of the leash type device 10 to the surfer's waist band 18 while still maintaining a connection between the surfer's ankle and the surf board 14 because of the leash type device 10.

Figure 2:
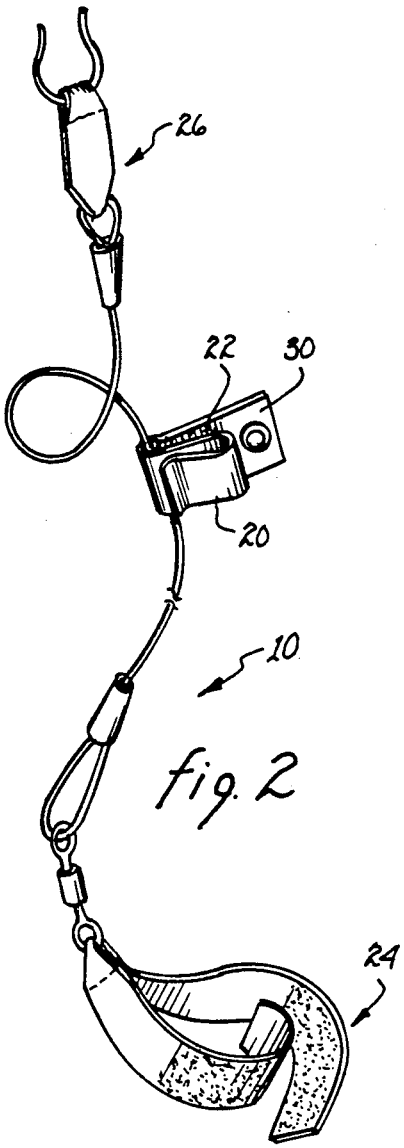
FIG. 2 is an enlarged view of the surf board leash device and method of FIG. 1 without showing the surf board.
Figure 4:
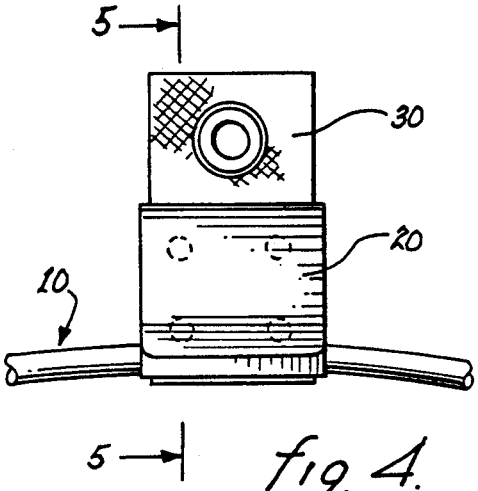
FIG. 4 is a side elevational view of the clip on portion as also shown in FIG. 3.
Figure 3:
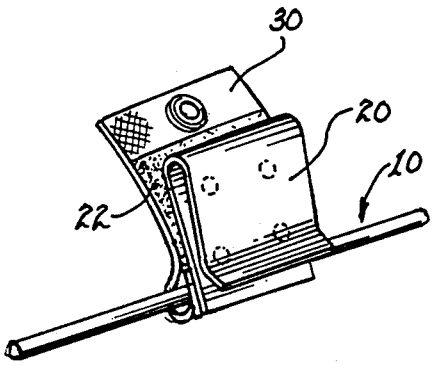
FIG. 3 is an enlarged view of the quick attach - quick detach clip on portion of the surf board leash device and method for attachment to the waist of a surfer's bathing or surfing suit which also shows a portion of the leash contained between two VELCRO members to permit break away of the leash during a surfer's fall.
Figure 5:
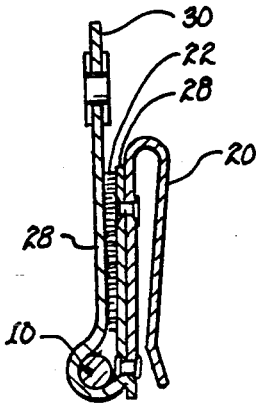
FIG. 5 is a sectional view taken along the line 5—5 of FIG. 4 showing the details of the clip on portion, the two adjacent break away VELCRO portions, and the leash.

As shown in FIG. 2, the entire surf board leash device 10 is shown. The leash device 10 is attached to the surf board 14 through the use of connection members 26. The leash device 10 must be long enough so that it can be attached to the surf board 14, also attached (through the use of the clip 20) to a surfer's waist band 18 and then attached to the surfer's ankle by means of the VELCRO ankle wrap 24. The leash device 10 contains the preferably plastic clip 20 that clips onto the waist band 18 of the swim suit of a surfer 12. As shown in FIGS. 3, 4, and especially, 5 the plastic belt clip 20 is attached by, for example, four rivets or any other fastening means to a cloth or other type of material 28. The cloth material 28 has "VELCRO" hooks or loops forming part of the VELCRO portions 22 attached or sewn onto one side of the cloth material 28. The side of the cloth material 28 containing VELCRO hooks or loops is the opposite side of the cloth material 28 that is attached to the plastic belt clip 20. The cloth material 28 is an elongated piece of material that wraps around and holds a portion of the leash device 10 (see FIGS. 2, 3, 4 and 5). An extended portion of the cloth material 28 has VELCRO loops or hooks (the opposite type from the VELCRO material located on the back portion of the cloth material 28 that is directly behind the belt clip 20). As shown in FIG. 5, the cloth material 28 wraps around and releasably attaches to the leash device 10 through the use of VELCRO hooks and loops located on the inside portions of the cloth material 28. The leash device 10 can now safely detach from the surfer's waist band 18 when the surfer 12 starts to fall off the surf board 14. The clip 20 with its connecting cloth material 28 is preferably located approximately half way between the ankle VELCRO member 24 and where the leash device 10 ties onto the surf board 14.

FIG. 5 shows how both inside portions of the cloth material 28 are securely fastened to each other through the use of VELCRO thereby holding in a break away fashion a portion of the leash device 10.

As discussed above, the leash device 10 also comprises the VELCRO ankle portions 24 which provide attachment to the ankle as shown in FIG. 1 by using the VELCRO portions to wrap around the surfer's ankle. Unlike the VELCRO portions 22 of the clip 20, the VELCRO ankle portions 24 will not break away and fall off the surfer's ankle because there is more VELCRO on both sides of the ankle loop than is used for the VELCRO portions 22 of the clip 20. Thus, when the surfer 12 falls or "wipes out" on a surf board 14, the VELCRO portions 22 of the clip 20 will break away before the VELCRO ankle portions 24 thereby providing a controlled fall, no entanglement between the surer's feet and the leash device 10 and reducing the risk of injury to the surfer 12. An upper toe or finger gripping portion 30 (see FIG. 2, 3, 4 and 5) permits finger gripping of the upper portion of the cloth material 28 to facilitate connection together of the VELCRO portions 22 thereof.

While the invention has been particularly shown and described in reference to the preferred embodiments thereof, it will be understood by those skilled in the art that changes in form and details may be made without departing from the spirit and scope of the invention.

What is claimed is:

1. A leash type device for a surfer to hold onto a surf board comprising, in combination:

an elongated leash member having one end thereof adapted to be connected to a surf board and the other end thereof adapted to be attached to the ankle of the surfer;

clip means attachably and detachably coupled to a portion of said elongated leash member for attaching said portion of said elongated leash member to the waist of said surfer; and ankle attachment means coupled to said other end of said elongated leash member for connecting the surfer to the surf board to prevent separation of the surfer from the surf board.

2. The leash type device of claim 1 wherein said clip means comprising first VELCRO means for providing both a rapid attachment to said portion of said elongated leash member and a quick break away to permit said portion of said elongated leash member to break away from the waist of said surfer when said surfer falls from said surf board.

3. The leash type device of claim 2 wherein said clip means with its first VELCRO means being located between said one end and said other end of said elongated leash member.

4. The leash type device of claim 3 wherein said clip means being located substantially midway between said one end and other end of said elongated leash member.

5. The leash type device of claim 2 wherein a loop is provided between VELCRO portions of said VELCRO means to hold said portion of said elongated leash member.

6. The leash type device of claim 1 wherein said ankle attachment means comprising second VELCRO means for providing attachment of the elongated leash member from the surf board to the ankle of said surfer.

7. The leash type device of claim 6 wherein said first VELCRO means contains less VELCRO material than said second VELCRO means to cause said first VELCRO means to break away from said portion of said elongated leash member before said second VELCRO means breaks away from the ankle of the surfer.

8. A method for providing a leash type device for a surfer to hold onto a surf board comprising the following steps:

providing an elongated leash member having one end thereof adapted to be connected to a surf board and the other end thereof adjusted to be attached to the ankle of the surfer;

providing attachably and detachably clip means coupled to a portion of said elongated leash member for attaching said portion of aid elongated leash member to the waist of said surfer; and coupling ankle attachment means to said other end of said elongated leash member for connecting the surfer to the surf board to prevent separation of the surfer from the surf board.

9. The method of claim 8 wherein said clip means comprising fixed VELCRO means for providing both a rapid attachment to said portion of said elongated leash member and a quick break away from the waist of said surfer when said surfer falls from said surf board.

10. The method of claim 9 wherein said ankle attachment means comprising second VELCRO means for providing attachment of the elongated leash member from surf board to the ankle of said surfer.

11. The method of claim 10 wherein said first VELCRO means contains less VELCRO material than said second VELCRO means to cause said first VELCRO means to break away from said portion of said elongated leash member before said second VELCRO means breaks away from the ankle of the surfer.

12. The method of claim 9 wherein said clip means with its first VELCRO means being located between said one end and said other end of said elongated leash member.

13. The method of claim 12 wherein said clip means being located substantially midway between said one end said other end of said elongated leash member.

14. The method of claim 9 wherein a loop is provided between VELCRO portions of said first VELCRO means to hold said portion of said elongated leash member.

* * * * *